US010370924B2

(12) United States Patent
Roberts-Haritonov et al.

(10) Patent No.: US 10,370,924 B2
(45) Date of Patent: Aug. 6, 2019

(54) POWERED SUBSEA TOOL ASSEMBLY, TO REINSTATE THE INTENDED FUNCTIONALITY OF A SUBSEA TREE VALVE ACTUATOR

(71) Applicant: Neptune Subsea Engineering Limited, Aberdeen (GB)

(72) Inventors: Lev Uryevich Roberts-Haritonov, Aberdeen (GB); Paul Collins, Inverurie (GB)

(73) Assignee: Neptune Subsea Engineering Limited, Aberdeen (GB)

( * ) Notice: Subject to any disclaimer, the term of this patent is extended or adjusted under 35 U.S.C. 154(b) by 0 days.

(21) Appl. No.: 15/125,227

(22) PCT Filed: Mar. 9, 2015

(86) PCT No.: PCT/GB2015/000084
§ 371 (c)(1),
(2) Date: Sep. 12, 2016

(87) PCT Pub. No.: WO2015/136234
PCT Pub. Date: Sep. 17, 2015

(65) Prior Publication Data

US 2017/0101839 A1 Apr. 13, 2017

(30) Foreign Application Priority Data

Mar. 12, 2014 (GB) ..... 1404320.2

(51) Int. Cl.

| | |
|---|---|
| ***F16K 31/00*** | (2006.01) |
| ***F16K 31/122*** | (2006.01) |
| ***F16K 31/50*** | (2006.01) |
| ***F16L 3/02*** | (2006.01) |
| ***E21B 33/035*** | (2006.01) |
| ***E21B 34/04*** | (2006.01) |

(52) U.S. Cl.
CPC ..... *E21B 33/0355* (2013.01); *E21B 34/04* (2013.01)

(58) Field of Classification Search
None
See application file for complete search history.

(56) References Cited

U.S. PATENT DOCUMENTS 6,089,531 A * 7/2000 Young ..... F16K 31/1262 251/285
6,223,675 B1 5/2001 Watt et al.
(Continued)

FOREIGN PATENT DOCUMENTS

EP 0366281 A 5/1990
GB 2350659 A 12/2000
(Continued)

*Primary Examiner* — Matthew R Buck
*Assistant Examiner* — Douglas S Wood

(57) ABSTRACT

A subsea powered override tool is described, for effective and permanent reinstatement of subsea tree valve actuation functionality. The override tool is powered from the Subsea Control Module on the subsea Christmas Tree. The override tool assembly comprise cylinder body (11), piston (8) and cylinder cap (2). A locking collar (1) that is part of the override tool is used to attach the tool to the actuator body on the subsea Tree. The override tool is designed for permanent installation and can lie dormant for extensive periods of time before use.

14 Claims, 3 Drawing Sheets

PCOL Tool attached valve actuator – extended position

(56) References Cited

U.S. PATENT DOCUMENTS

| | | | | |
|---|---|---|---|---|
| 7,913,971 | B2 * | 3/2011 | Hoang | E21B 34/04 251/14 |
| 9,500,294 | B2 * | 11/2016 | Herman | F16K 31/122 |
| 2004/0118567 | A1 | 6/2004 | Skeels et al. | |
| 2008/0264646 | A1 * | 10/2008 | Sten-Halvorsen | E21B 33/0355 166/360 |
| 2009/0212969 | A1 | 8/2009 | Voss | |
| 2012/0067593 | A1 | 3/2012 | Powell et al. | |
| 2012/0168169 | A1 | 7/2012 | Voss | |

FOREIGN PATENT DOCUMENTS

| | | | |
|---|---|---|---|
| GB | 2458012 | A | 9/2009 |
| GB | 2514150 | A | 11/2014 |
| GB | 2520258 | A | 5/2015 |
| WO | 2009/114704 | A2 | 9/2009 |
| WO | 2012154056 | A | 11/2012 |
| WO | 2014/155126 | A2 | 10/2014 |

* cited by examiner

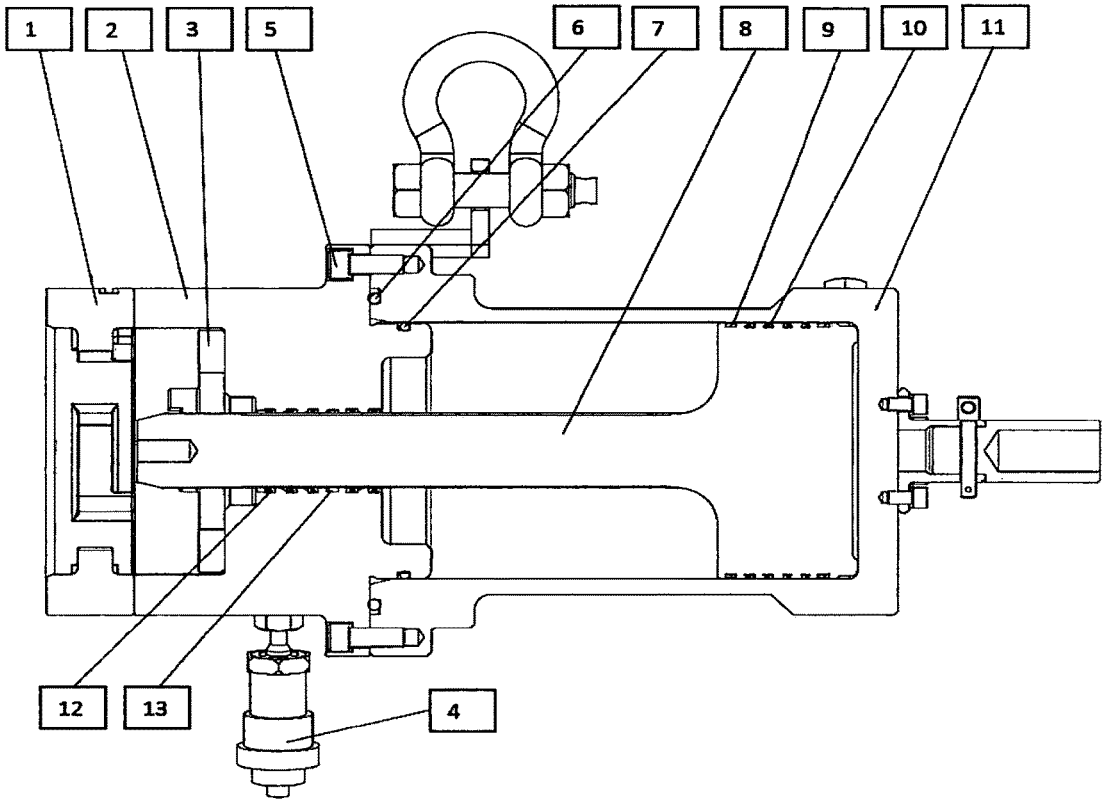
Fig. 1 PCOL Tool Cross Section

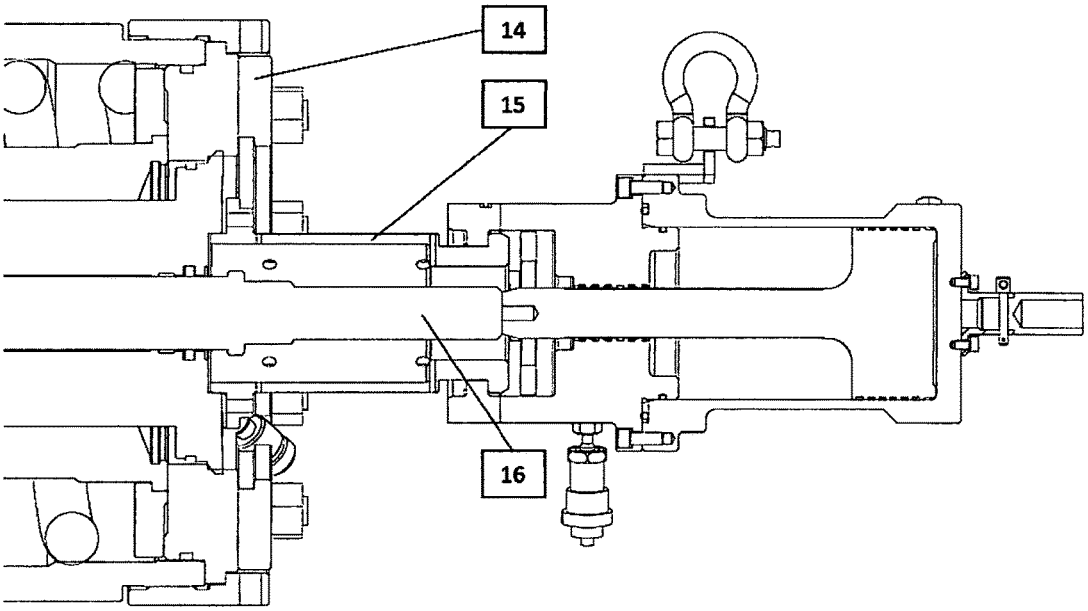
Fig. 2 PCOL Tool attached valve actuator – extended position
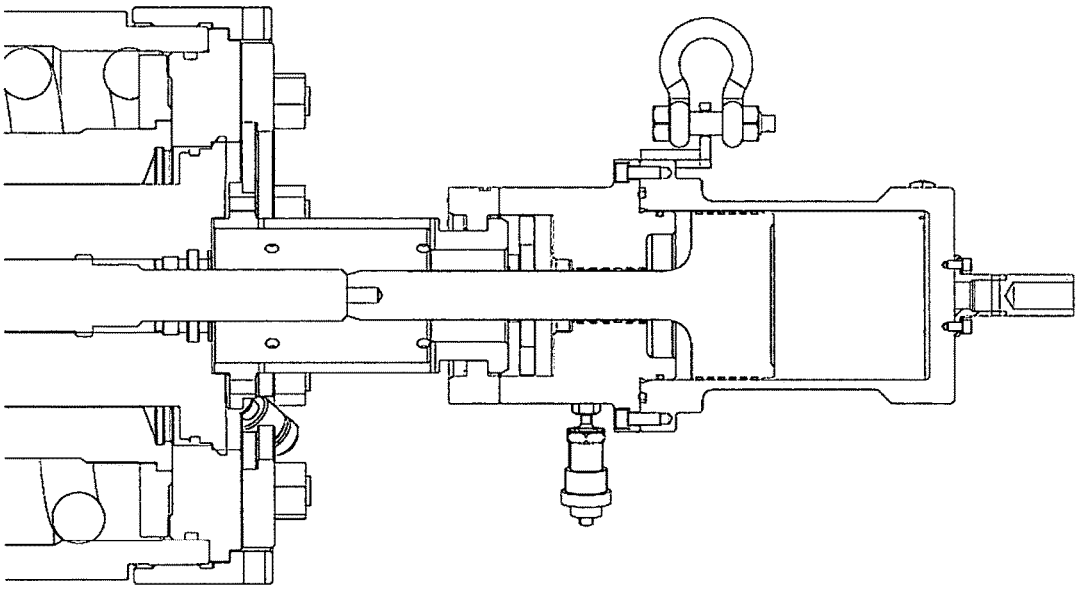
Fig. 3 PCOL Tool attached valve actuator – retracted position

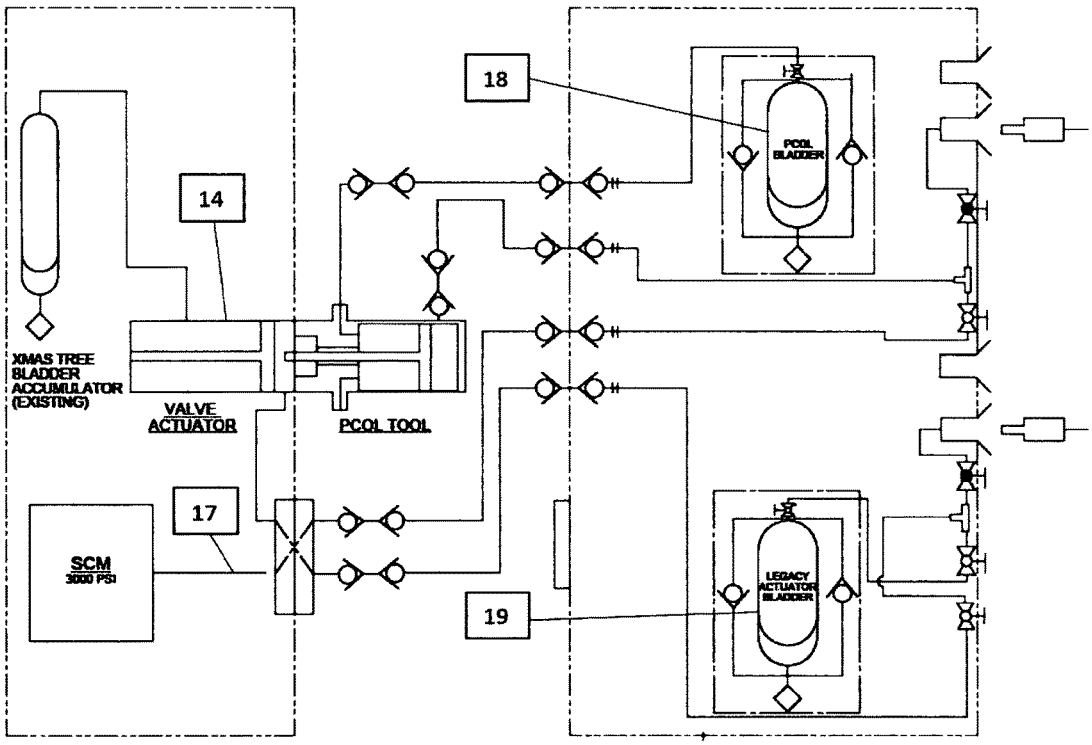
Fig. 4 PCOL Tool control routing and compensation system to both original actuator & override tool

POWERED SUBSEA TOOL ASSEMBLY, TO REINSTATE THE INTENDED FUNCTIONALITY OF A SUBSEA TREE VALVE ACTUATOR

TECHNICAL FIELD

The present invention relates to a fluid actuated Permanently Controlled Override Linear (PCOL) Tool assembly which is attached to an actuator. The actuator is part of a subsea Christmas tree valve. The PCOL Tool provides override functionality to a potentially leaking, damaged, or partially seized actuator on a subsea tree valve. The legacy (existing) actuator may no longer be able to open or close the subsea tree valve or may have an unsustainable leak rate during normal planned periods of production/injection. By installing the PCOL tool and rerouting the SCM control fluid, the intended functionality of the original/legacy actuator and tree valve is reinstated in full. This includes reinstatement of the valve closing time, well integrity test criteria on the gate, Emergency Shut Down procedure from the host installation and general functionality logic using original software on the host installation. The PCOL Tool does this by applying a thrust load to the actuator stem, which in turns actuates the subsea tree valve. The PCOL tool could get its fluid supply and pressure for thrust load from the existing subsea control module on the subsea tree, to which it will be connected on a permanent basis. The tool is intended for permanent subsea installation and extensive periods of dormancy.

BACKGROUND ART

The primary function of a subsea Christmas tree, is to control flow of oil and gas or injection fluids to and from a subsea well. Subsea trees incorporate a number of valves in their construction for various functions.

A typical conventional or horizontal Christmas tree will include a production/injection master valve (PMV/IMV) and wing valves on both the production/injection wing of the tree (PWV/IWV) as well as the annulus wing of the tree (AWV). The AWV is more common on wells which require the supply of gas to well 'A' annulus. On a subsea production tree, they are used to control the flow of oil/gas from the well. Equally, they are used for controlling the flow of injection fluid, if the subsea tree is an injection tree. These valves in all cases above are typically gate valves.

The subsea tree valves are actuated from closed to open position and back, using hydraulic linear actuators which are attached directly to the valves. The control of these actuators and supply of hydraulic fluid to them is done via a subsea control module (SCM), located on the tree. The SCM in turn is controlled by commands from the host installation.

Extensive subsea operation can result in leakage of hydraulic fluid from the valve actuators, causing their failure and inability to stroke the subsea tree valves. In such cases, an extensive completion work over or subsea intervention is required, to be able to recover the tree to the surface for actuator replacement. This type of operation requires a rig or vessel with the correct hardware and safety case. The consequential period of rectification will result in the well shut in and a loss of production revenue.

An established solution to a leaking/non-functioning actuator is to provide a surface override tool which would typically be installed by a diver, if water depths permit. The thrust power would be provided via a subsea hand pump. The major disadvantage is that the diver has to remain on location to provide hydraulic fluid power to the override tool. The alternative is to leave the tool locked on to the actuator leaving, the valve permanently open. A valve locked open without the ability to close for Well Control purposes will require a deviation from the Operator's Standard Operating Policies and require dispensation from periodic Well Control Integrity testing. In most cases the regional Government acting body will be notified. For the UK sector this is the Department of Energy & Climate Change (DECC). In vast majority of cases it is impracticable to maintain this level of support.

An alternative to using divers as described above is to deploy the same type of tooling using a Remotely Operated Vehicle (ROV). The tooling is near identical but with the subtle difference of being mounted onto a, ROV Tool Deployment Unit (TDU) or manipulator with the fluid power supply being fed via the ROV hydraulic system. As in the diver installed case, the ROV will have to remain on station providing hydraulic power to the override tool. If the ROV locks the actuator and valve open, the same deviation and dispensations as described above will apply. It is impractical for the ROV to remain in the subsea position providing power for an indefinite time period.

Equally, in both diver and ROV operations, the override tool is not designed to remain submerged subsea for extensive periods of time and as such, cannot provide permanent reinstatement to the valve actuator. This present invention seeks to overcome the aforementioned disadvantages.

Disclosure of Invention

With a view to mitigating the foregoing disadvantages there is provided in accordance with the first aspect of the invention, and enabling effective and permanent reinstatement of subsea tree valve actuation functionality, an SCM actuated override tool, connected to the actuator body and able to provide a thrust force onto the actuator stem thus enabling full travel against the original actuator spring and well pressure.

The PCOL Tool comprises of a pressure containing body; and a thrust rod which would engage with the actuator stem. A means of sealing will be provided between the pressure containing body, the thrust rod and the external environment.

The hydraulic fluid and pressure to power the PCOL Tool will be routed from the existing subsea control module (SCM).

BRIEF DESCRIPTION OF DRAWINGS

The invention will now be described further by way of example, with reference to the accompanying annotated drawings.

FIG. 1, PCOL Tool cross section

FIG. 2, PCOL Tool attached valve actuator—extended position

FIG. 3, PCOL Tool attached valve actuator—retracted position

FIG. 4, PCOL Tool control routing and compensation system to both original actuator & override Tool

BEST MODE FOR CARRYING OUT THE INVENTION

In the present invention, the PCOL Tool as shown in FIG. 1, comprises of a pressure containing Cylinder Body 11, which is attached to the Cylinder Cap 2. These together form a fluid and pressure containing chamber. The Cylinder Cap 2 is connected to the Cylinder Body 11 by Socket Head Cap Screw 5 and the sealing is provided by O Ring Face Seal 6 and O Ring 7. To provide a thrust force, a Piston 8 is provided. Piston Seals 10 are provided to seal between Cylinder Body 11 and Piston 8. Piston Guide Rings 9 provide guidance for the Piston 8. Similarly Rod Seal 12 and Rod Guide Rings 13 provides sealing and guidance to the Piston 8 passing through the Cylinder Cap 2.

The PCOL Tool is shown connected to the Actuator 14 in FIG. 2. The PCOL Tool is attached to the Actuator 14 via the Actuator Bayonet 15, by the FIG. 4 PCOL Tool control routing and compensation system to both original actuator and override tool and Cylinder Cap 2. The Piston 8 makes face to face contact with the Actuator Stem 16 and as such is able to provide the required thrust. To connect the hydraulic supply to the PCOL Tool, the existing SCM supply line 17 to the actuator is rerouted to the PCOL Tool supply, as shown in FIG. 4. The supply cavity on the original Actuator 14 is rerouted to an Actuator compensation bladder 18, to prevent seawater ingress into the actuator. The PCOL Tool will be fitted with its own PCOL Tool compensation bladder 19.

Not Part of Patent Text
End Collar 1
Cylinder Cap 2
Locking Collar 3
Wet Mate Connection 4
Socket Head Cap Screw 5
O Ring Face Seal 6
O Ring 7
Piston 8
Piston Guide Rings 9
Piston Seals 10
Cylinder Body 11
Road Seal 12
Rod Guide Rings 13
Actuator 14
Actuator Bayonet 15
Actuator Stem 16
Existing SCM supply line 17
Actuator compensation bladder 18
PCOL tool compensation bladder 19

INDUSTRIAL APPLICABILITY

Subsea oil and gas energy sector.

The invention claimed is:

1. A subsea tool for permanently reinstating the functionality of a subsea tree valve actuator, by applying a thrust force to a subsea tree valve actuator stem, comprising a cylinder body which defines a fluid and pressure containing chamber, and a thrust rod for engaging with the tree valve actuator stem of the subsea tree valve actuator wherein:

the tool gets its hydraulic supply to provide load on the actuator stem directly from a subsea tree SCM (subsea control module) hydraulic supply via an existing SCM hydraulic supply line to the subsea tree valve actuator stem, the subsea tool including a SCM supply line connector;

wherein the hydraulic supply for the tool is shared with the existing SCM hydraulic supply line for the subsea tree valve actuator; and wherein the subsea tree valve actuator is a hydraulic actuator.

2. A subsea tool for permanently reinstating the functionality of a subsea tree valve actuator as claimed in claim 1, wherein the thrust rod for engaging with an actuator stem comprises a piston.

3. A subsea tool for permanently reinstating the functionality of a subsea tree valve actuator as claimed in claim 1, wherein the tool incorporates a bladder system connected to an annulus and/or a cylinder side of the tool.

4. A subsea tool for permanently reinstating the functionality of a subsea tree valve actuator as claimed in claim 1, wherein the connector is a wet mate connector.

5. A subsea tool for permanently reinstating the functionality of a subsea tree valve actuator as claimed in claim 1, further including a bayonet connector.

6. A subsea tool for permanently reinstating the functionality of a subsea tree valve actuator as claimed in claim 1, further including a locking collar.

7. A subsea tool for permanently reinstating the functionality of a subsea tree valve actuator as claimed in claim 1, wherein an end of the subsea tree valve actuator stem located distal to the subsea tree valve makes face to face contact with a lower end of a piston of the tool.

8. A subsea tool for permanently reinstating the functionality of a subsea tree valve actuator as claimed in claim 1, wherein the tool comprises a tool compensation bladder, and wherein to connect the existing SCM hydraulic supply line to the tool, the existing SCM hydraulic supply line to the subsea tree valve actuator is rerouted to the SCM supply line, and a supply cavity on the subsea tree valve actuator is rerouted to an actuator compensation bladder to prevent seawater ingress into the subsea tree valve actuator.

9. A method for permanently reinstating the functionality of a subsea tree valve actuator comprising the steps of:

applying a thrust force to the subsea tree valve actuator stem with a tool according to claim 1, and using the subsea tree SCM (subsea control module) hydraulic supply to provide hydraulic power to the tool via the existing SCM hydraulic supply line to the subsea tree valve actuator stem.

10. A method for permanently reinstating the functionality of a subsea tree valve actuator as claimed in claim 9, wherein the tool that is installed and left connected to the actuator for any length of time, up to the maximum design life of the tool.

11. A method for permanently reinstating the functionality of a subsea tree valve actuator as claimed in claim 9, wherein the tool is connected to the actuator body.

12. A method for permanently reinstating the functionality of a subsea tree valve actuator as claimed in claim 9, wherein the tool provides a thrust to the actuator stem.

13. A method for permanently reinstating the functionality of a subsea tree valve actuator as claimed in claim 9, wherein the tool incorporates a bladder system connected to an annulus and/or a cylinder side of the tool.

14. A method for permanently reinstating the functionality of a subsea tree valve actuator as claimed in claim 9, wherein the supply cavity on the actuator is rerouted to an actuator compensation bladder.

* * * * *